US010186213B2

(12) United States Patent
Oh et al.

(10) Patent No.: US 10,186,213 B2
(45) Date of Patent: Jan. 22, 2019

(54) DISPLAY PANEL AND DISPLAY APPARATUS HAVING THE SAME

(71) Applicant: SAMSUNG DISPLAY CO., LTD., Yongin-si, Gyeonggi-Do (KR)

(72) Inventors: Won-Sik Oh, Seoul (KR); Tae-Jin Kim, Hwaseong-si (KR); Kuk-Hwan Ahn, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 17 days.

(21) Appl. No.: 14/855,907

(22) Filed: Sep. 16, 2015

(65) Prior Publication Data

US 2016/0260394 A1 Sep. 8, 2016

(30) Foreign Application Priority Data

Mar. 5, 2015 (KR) ..... 10-2015-0031098

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01);
(Continued)

(58) Field of Classification Search
CPC ... G09G 2300/0426; G09G 2300/0452; G09G 2310/08; G09G 2320/0233;
(Continued)

(56) References Cited

U.S. PATENT DOCUMENTS

2004/0012555 A1* 1/2004 Yamashita ..... G09G 3/3688 345/100
2007/0182685 A1* 8/2007 Park ..... G09G 3/3648 345/96

(Continued)

FOREIGN PATENT DOCUMENTS

EP 2953127 A2 12/2015
KR 1020070093614 9/2007

(Continued)

OTHER PUBLICATIONS

European Office Action dated Mar. 8, 2018 for Patent Application No. 16158216.8.

*Primary Examiner* — Tony Davis
(74) *Attorney, Agent, or Firm* — F.Chau & Associates, LLC

(57) ABSTRACT

A display panel includes a plurality of gate lines extending in a first direction and including first and second gate lines adjacent to each other. A plurality of data lines extends in a second direction that crosses the first direction and includes first and second data lines adjacent to each other. A plurality of sub-pixels are arranged in a matrix configuration, each row of the matrix being disposed between two adjacent gate lines, from among the plurality of gate lines, each column of the matrix being disposed between two adjacent data lines, from among the plurality of data lines. The plurality of sub-pixels includes first column sub-pixels disposed on a first column of the matrix and connected to the first data line. Second column sub-pixels are disposed on a second column of the matrix and are connected to the second data line, the second column being adjacent to the first column. First row sub-pixels are disposed on a first row of the matrix and are alternately connected to the first and second gate lines in units of two sub-pixels.

20 Claims, 7 Drawing Sheets

(52) U.S. Cl.
CPC ..... *G09G 3/3685* (2013.01); *G09G 3/3696* (2013.01); *G09G 2300/0426* (2013.01); *G09G 2300/0452* (2013.01); *G09G 2310/08* (2013.01); *G09G 2320/0233* (2013.01); *G09G 2320/0247* (2013.01); *G09G 2320/0673* (2013.01)

(58) Field of Classification Search
CPC ... G09G 2320/0247; G09G 2320/0673; G09G 3/3607; G09G 3/3614; G09G 3/3648; G09G 3/3685; G09G 3/3696
USPC ..... 345/58, 96, 100, 205, 690
See application file for complete search history.

(56) References Cited

U.S. PATENT DOCUMENTS

2008/0158131 A1 7/2008 Park et al.
2008/0284758 A1 11/2008 Lee et al.
2010/0231614 A1* 9/2010 Vieri ..... G09G 3/3677 345/690
2012/0249492 A1* 10/2012 Kim ..... G09G 3/3648 345/204
2013/0113766 A1* 5/2013 Kim ..... G09G 3/3648 345/205
2014/0210868 A1* 7/2014 Cho ..... G09G 3/3648 345/690
2014/0313113 A1* 10/2014 Jang ..... G09G 3/3614 345/87
2015/0035739 A1* 2/2015 Jeong ..... G09G 3/2003 345/89
2015/0325197 A1* 11/2015 Hong ..... G09G 5/18 345/205
2015/0348481 A1* 12/2015 Hong ..... G09G 3/2003 345/690
2016/0018693 A1* 1/2016 Um ..... G09G 3/3688 345/58
2016/0049123 A1* 2/2016 Jeong ..... G09G 3/3607 345/690
2016/0071473 A1* 3/2016 Ahn ..... G09G 3/3614 345/690
2016/0133176 A1* 5/2016 Oh ..... G09G 3/3614 345/691
2016/0133214 A1* 5/2016 Kwon ..... G09G 3/3614 345/87
2016/0189642 A1* 6/2016 Shin ..... G09G 3/3648 345/690
2016/0195786 A1* 7/2016 Son ..... G02F 1/13624 349/43
2016/0232862 A1* 8/2016 Kim ..... G09G 3/3614
2016/0275862 A1* 9/2016 Riedel ..... G09G 3/20
2017/0033173 A1* 2/2017 Kim ..... H01L 27/3276
2017/0069278 A1* 3/2017 Kim ..... G09G 3/3614

FOREIGN PATENT DOCUMENTS

KR 1020100070744 6/2010
KR 10-2010-0129666 12/2010
KR 1020120044401 5/2012
KR 1020150069411 6/2015
KR 1020150139132 12/2015
KR 1020160083325 7/2016

* cited by examiner

DISPLAY PANEL AND DISPLAY APPARATUS HAVING THE SAME

PRIORITY STATEMENT

This application claims priority under 35 U.S.C. § 119 to Korean Patent Application No. 10-2015-0031098, filed on Mar. 5, 2015, in the Korean Intellectual Property Office (KIPO), the disclosure of which is incorporated by reference herein in its entirety.

TECHNICAL FIELD

Exemplary embodiments of the present inventive concept relate to a display panel, and more particularly, exemplary embodiments of the present inventive concept relate to a display panel and a display apparatus having the display panel.

DISCUSSION OF THE RELATED ART

A display apparatus such as a liquid crystal display apparatus may include a display panel and a driving circuit configured to drive the display panel. The display panel may include a plurality of gate lines, a plurality of data lines and a plurality of pixels. The plurality of pixels may be arranged in a matrix configuration on a divisional area divided by the plurality of gate lines and the plurality of data lines.

Data voltages having a positive or a negative polarity may be applied to the plurality of pixels. A horizontal or a vertical line may be perceived by a viewer when pixels having the same polarity are consecutively arranged.

The plurality of pixels may be connected to an upper gate line or a lower gate line. A brightness of pixels connected to the upper gate line may be different from a brightness of pixels connected to the lower gate line due to a manufacturing defect. As a result, if pixels connected to the upper or lower gate lines are consecutively arranged in a vertical direction, a vertical line may be perceived by a viewer.

SUMMARY

Exemplary embodiments of the present inventive concept relate to a display panel where sub-pixels are arranged in a vertical direction to create columns of sub-pixels. The columns of sub-pixels are repeatedly arranged in a horizontal direction to form rows of sub-pixels. Sub-pixels, along a row of sub-pixels disposed between two gate lines, have different polarities and are connected to different gate lines.

Exemplary embodiments of the present inventive concept relate to a display apparatus having the display panel.

According to an exemplary embodiment of the present inventive concept, a display panel includes a plurality of gate lines extending in a first direction and including first and second gate lines adjacent to each other. A plurality of data lines extends in a second direction that crosses the first direction and includes first and second data lines adjacent to each other. A plurality of sub-pixels are arranged in a matrix configuration, each row of the matrix being disposed between two adjacent gate lines, from among the plurality of gate lines, each column of the matrix being disposed between two adjacent data lines, from among the plurality of data lines. The plurality of sub-pixels includes first column sub-pixels disposed on a first column of the matrix and connected to the first data line. Second column sub-pixels are disposed on a second column of the matrix and are connected to the second data line, the second column being adjacent to the first column. First row sub-pixels are disposed on a first row of the matrix and are alternately connected to the first and second gate lines in units of two sub-pixels.

In an exemplary embodiment of the present inventive concept, the plurality of gate lines further includes a third gate line adjacent to the second gate line. The plurality of sub-pixels further includes second row sub-pixels disposed on a second row of the matrix and alternately connected to the second and third gate lines in units of two sub-pixels, the second row being adjacent to the first row. When a first sub-pixel disposed on the first row and the first column of the matrix is connected to the first gate line, a second sub-pixel disposed on the second row and the first column of the matrix is connected to the second gate line.

In an exemplary embodiment of the present inventive concept, the first row sub-pixels include first through fourth sub-pixels disposed between the first and second gate lines and sequentially arranged along the first direction. The first and second sub-pixels are connected to the first gate line, and the third and fourth sub-pixels are connected to the second gate line.

In an exemplary embodiment of the present inventive concept, the first sub-pixel displays a first color, the second sub-pixel displays a second color, the third sub-pixel displays a third color, and the fourth sub-pixel displays a fourth color.

In an exemplary embodiment of the present inventive concept, the first color is red, the second color is green, the third color is blue, and the fourth color is white.

In an exemplary embodiment of the present inventive concept, the plurality of data lines further includes third and fourth data lines adjacent to each other, the third data line being adjacent to the second data line. The first and second data lines are configured to apply data voltages having a first polarity to the first and second sub-pixels, respectively. The second and third data lines are configured to apply data voltages having a second polarity to the third and fourth sub-pixels, respectively, the second polarity being different from the first polarity.

In an exemplary embodiment of the present inventive concept, the plurality of data lines further includes third and fourth data lines adjacent to each other, the third data line being adjacent to the second data line. The first and fourth data lines are configured to apply data voltages having a first polarity to the first and fourth sub-pixels, respectively. The second and third data lines are configured to apply data voltages having a second polarity to the second and third sub-pixels, respectively, the second polarity being different from the first polarity.

In an exemplary embodiment of the present inventive concept, the plurality of gate lines further includes a third gate line adjacent to the second gate line. The plurality of sub-pixels further includes second row sub-pixels disposed on a second row of the matrix, the second row being adjacent to the first row. The second row sub-pixels include fifth through eighth sub-pixels disposed between the second and third gate lines and sequentially arranged along the first direction. The fifth sub-pixel is adjacent to the first sub-pixel and the sixth sub-pixel is adjacent to the second sub-pixel, the fifth and sixth sub-pixels are connected to the second gate line. The seventh sub-pixel is adjacent to the third sub-pixel and the eighth sub-pixel is adjacent to the fourth sub-pixel, the seventh and eighth sub-pixels are connected to the third gate line.

In an exemplary embodiment of the present inventive concept, the first row sub-pixels further include fifth through eighth sub-pixels disposed between the first and second gate lines and sequentially arranged along the first direction. The fifth sub-pixel is adjacent to the fourth sub-pixel. The fifth and sixth sub-pixels are connected to the first gate line, and the seventh and eighth sub-pixels are connected to the second gate line.

In an exemplary embodiment of the present inventive concept, the first sub-pixel is disposed between the first and second data lines and is connected to the first data line.

In an exemplary embodiment of the present inventive concept, the plurality of data lines further includes a third data line adjacent to the second data line, and the first sub-pixel is disposed between the second and third data lines and is connected to the second data line.

In an exemplary embodiment of the present inventive concept, a first pixel includes the first and second sub-pixels, and a second pixel includes the third and fourth sub-pixels.

According to an exemplary embodiment of the present inventive concept, a display apparatus includes a display panel. The display panel includes a plurality of gate lines extending in a first direction and including first and second gate lines adjacent to each other. A plurality of data lines extends in a second direction that crosses the first direction and includes first and second data lines adjacent to each other. A plurality of sub-pixels are arranged in a matrix configuration. Each row of the matrix is disposed between adjacent gate lines, from among the plurality of gate lines, and each column of the matrix is disposed between adjacent data lines, from among the plurality of data lines. The plurality of sub-pixels includes first column sub-pixels disposed on a first column of the matrix and connected to the first data line. Second column sub-pixels are disposed on a second column of the matrix and are connected to the second data line. The second column is adjacent to the first column, and first row sub-pixels are disposed on a first row of the matrix and alternately connected to the first and second gate lines in units of two sub-pixels. The display apparatus includes a data driver configured to output data voltages to the plurality of data lines, and a gate driver configured to output gate voltages to the plurality of gate lines.

In an exemplary embodiment of the present inventive concept, the plurality of gate lines further includes a third gate line adjacent to the second gate line, the plurality of sub-pixels further includes second row sub-pixels disposed on a second row of the matrix and alternately connected to the second and third gate lines in units of two sub-pixels. The second row is adjacent to the first row. When a first sub-pixel disposed on the first row and the first column of the matrix is connected to the first gate line, a second sub-pixel disposed on the second row and the first column of the matrix is connected to the second gate line.

In an exemplary embodiment of the present inventive concept, the first row sub-pixels include first through fourth sub-pixels disposed between the first and second gate lines and sequentially arranged along the first direction. The first and second sub-pixels are connected to the first gate line, and the third and fourth sub-pixels are connected to the second gate line.

In an exemplary embodiment of the present inventive concept, the first sub-pixel displays a first color, the second sub-pixel displays a second color, the third sub-pixel displays a third color, and the fourth sub-pixel displays a fourth color.

In an exemplary embodiment of the present inventive concept, the plurality of data lines further includes third and fourth data lines adjacent to each other, the third data line being adjacent to the second data line. The first and second data lines are configured to apply data voltages having a first polarity to the first and second sub-pixels, respectively. The second and third data lines are configured to apply data voltages having a second polarity to the third and fourth sub-pixels, respectively, the second polarity being different from the first polarity.

In an exemplary embodiment of the present inventive concept, the plurality of data lines further includes third and fourth data lines adjacent to each other, the third data line being adjacent to the second data line. The first and fourth data lines are configured to apply data voltages having a first polarity to the first and fourth sub-pixels, respectively. The second and third data lines are configured to apply data voltages having a second polarity to the second and third sub-pixels, respectively, the second polarity being different from the first polarity.

In an exemplary embodiment of the present inventive concept, the plurality of gate lines further includes a third gate line adjacent to the second gate line, the plurality of sub-pixels further includes second row sub-pixels disposed on a second row of the matrix, the second row being adjacent to the first row. The second row sub-pixels include fifth through eighth sub-pixels disposed between the second and third gate lines and sequentially arranged along the first direction. The fifth sub-pixel is adjacent to the first sub-pixel and the sixth sub-pixel is adjacent to the second sub-pixel. The fifth and sixth sub-pixels are connected to the second gate line. The seventh sub-pixel is adjacent to the third sub-pixel and the eighth sub-pixel is adjacent to the fourth sub-pixel, the seventh and eighth sub-pixels are connected to the third gate line.

In an exemplary embodiment of the present inventive concept, the first row sub-pixels further include fifth through eighth sub-pixels disposed between the first and second gate lines and sequentially arranged along the first direction. The fifth sub-pixel is adjacent to the fourth sub-pixel. The fifth and sixth sub-pixels are connected to the first gate line, and the seventh and eighth sub-pixels are connected to the second gate line.

In an exemplary embodiment of the present inventive concept, the first sub-pixel is disposed between the first and second data lines and is connected to the first data line.

In an exemplary embodiment of the present inventive concept, a display panel and a display apparatus having the display panel, in a red, green, blue, and white (RGBW) pixel array having four different colored sub-pixels, the sub-pixels are alternately connected to an upper gate line and a lower gate line in units of two sub-pixels to avoid consecutively arranged sub-pixels having the same color being connected to the same gate line.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION OF THE EMBODIMENTS

Exemplary embodiments of the present inventive concept will be explained in detail with reference to the accompanying drawings.

Figure 1:
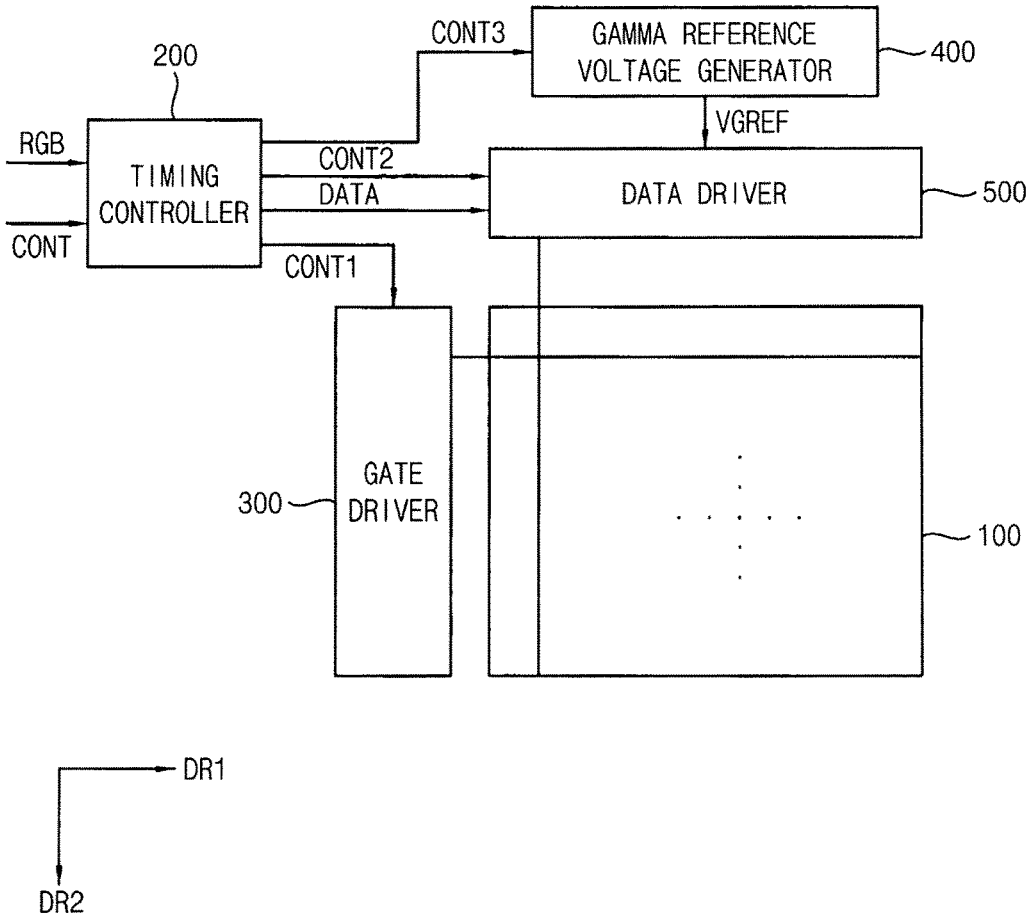
FIG. 1 illustrates a block diagram of a display apparatus according to exemplary embodiments of the present inventive concept.

FIG. 1 illustrates a block diagram of a display apparatus according to exemplary embodiments of the present inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region adjacent to the display region.

According to exemplary embodiments of the present inventive concept, the display panel 100 includes a plurality of gate lines, a plurality of data lines, and a plurality of pixels connected to the gate lines and the data lines. The gate lines may extend in the first direction DR1 and the data lines may extend in a second direction DR2 crossing the first direction DR1. According to an exemplary embodiment of the present inventive concept, the data lines and the gate lines are substantially perpendicular to each other.

In some exemplary embodiments of the present inventive concept, the pixels may include a switching element, a liquid crystal capacitor, and a storage capacitor. The liquid crystal capacitor and the storage capacitor of each pixel may be electrically connected to the switching element of the corresponding pixel. The pixels may be arranged in a matrix configuration.

The display panel 100 will be described in detail with reference to FIGS. 2A, 2B, 2C, 2D, 3A and 3B.

The timing controller 200 may receive input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 may generate a first control signal CONT1, a second control signal CONT2, a third control signal CONT3 and a data signal DATA based on the input image data RGB and the input control signal CONT.

The timing controller 200 may generate the first control signal CONT1 for controlling operations of the gate driver 300 based on the input control signal CONT. The timing controller 200 may output the first control signal CONT1 to the gate driver 300. The first control signal CONT1 may include a vertical start signal and a gate clock signal.

The timing controller 200 may generate the second control signal CONT2 for controlling operations of the data driver 500 based on the input control signal CONT. The timing controller 200 may output the second control signal CONT2 to the data driver 500. The second control signal CONT2 may include a horizontal start signal and a load signal.

The timing controller 200 may generate the data signal DATA based on the input image data RGB. The timing controller 200 may output the data signal DATA to the data driver 500.

The timing controller 200 may generate the third control signal CONT3 for controlling operations of the gamma reference voltage generator 400 based on the input control signal CONT. The timing controller 200 may output the third control signal CONT3 to the gamma reference voltage generator 400.

The gate driver 300 may generate gate signals for driving the gate lines in response to the first control signal CONT1 received from the timing controller 200. The gate driver 300 may sequentially output the gate signals to the gate lines.

In some exemplary embodiments of the present inventive concept, the gate driver 300 may be directly mounted (e.g., disposed) on the display panel 100, or may be connected to the display panel 100 as a tape carrier package (TCP) type. Alternatively, the gate driver 300 may be integrated in the peripheral region of the display panel 100.

The gamma reference voltage generator 400 may generate a gamma reference voltage VGREF in response to the third control signal CONT3 received from the timing controller 200. The gamma reference voltage generator 400 may output the gamma reference voltage VGREF to the data driver 500. The level of the gamma reference voltage VGREF may correspond to grayscales of a plurality of pixel data included in the data signal DATA.

In some exemplary embodiments of the present inventive concept, the gamma reference voltage generator 400 may be disposed in the timing controller 200, or may be disposed in the data driver 500.

The data driver 500 may receive the second control signal CONT2 and the data signal DATA from the timing controller 200. The data driver 500 may receive the gamma reference voltage VGREF from the gamma reference voltage generator 400. The data driver 500 may convert the data signal DATA to data voltages having analogue levels based on the gamma reference voltage VGREF. The data driver 500 may output the data voltages to the data lines.

In some exemplary embodiments of the present inventive concept, the data driver 500 may be directly mounted on the display panel 100, or may be connected to the display panel 100 as a TCP type. Alternatively, the data driver 500 may be integrated in the peripheral region of the display panel 100.

Figure 2A:
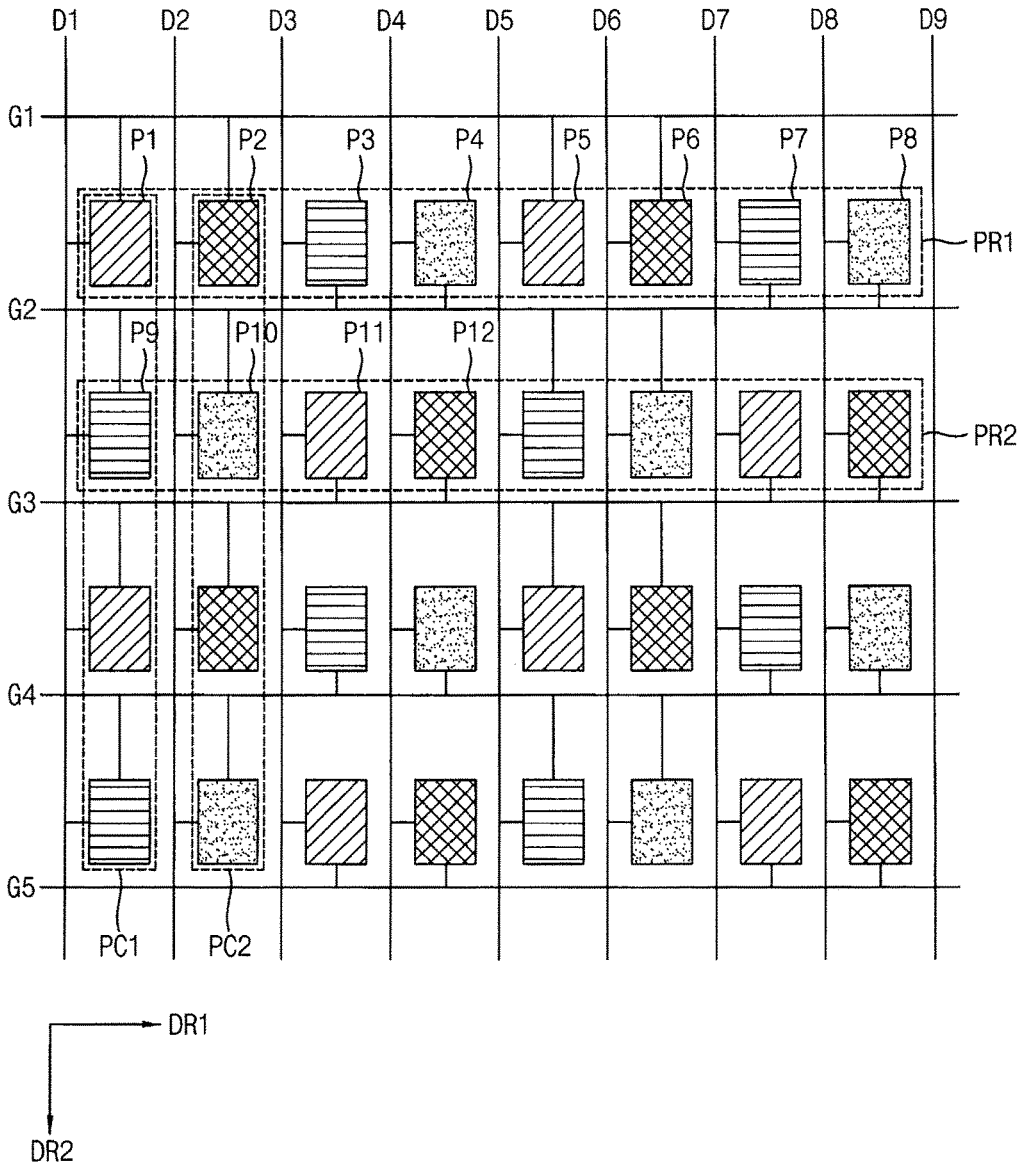
FIG. 2A illustrates a diagram of a pixel arrangement of a display panel of the display apparatus illustrated in FIG. 1, according to exemplary embodiments of the present inventive concept.

FIG. 2A illustrates a diagram of a pixel arrangement of a display panel of the display apparatus illustrated in FIG. 1, according to exemplary embodiments of the present inventive concept.

Referring to FIGS. 1 and 2A, according to exemplary embodiments of the present inventive concept, the display panel 100 includes a plurality of gate lines, a plurality of data lines and a plurality of pixels.

The gate lines may extend in the first direction DR1. The gate lines may include a first gate line G1 and a second gate line G2 adjacent to the first gate line G1. The gate lines may further include a third gate line G3 adjacent to the second gate line G2, a fourth gate line G4 adjacent to the third gate line G3 and a fifth gate line G5 adjacent to the fourth gate line G4.

The data lines may extend in the second direction DR2 crossing the first direction DR1. The data lines may include first through fourth data lines D1, D2, D3 and D4 sequentially arranged along the first direction DR1. The data lines may further include fifth through ninth data lines D5, D6, D7, D8 and D9 sequentially arranged along the first direction DR1. The fifth data line D5 may be adjacent to the fourth data line D4.

Each of the pixels may include a plurality of sub-pixels. For example, each of the pixels may include two sub-pixels. The sub-pixels may be arranged in a matrix configuration. Rows of the matrix may be disposed between the plurality of gate lines. Columns of the matrix may be disposed between the plurality of data lines. Each of the sub-pixels may be connected to one of the plurality of the gate lines and one of the plurality of data lines.

First column sub-pixels disposed on a first column PC1 of the matrix may be connected to the first data line D1. Second column sub-pixels disposed on a second column PC2 of the matrix adjacent to the first column PC1 may be connected to the second data line D2. Thus, sub-pixels may be connected to a data line disposed on the left side of the sub-pixels. Alternatively, sub-pixels may be connected to a data line disposed on the right side of the sub-pixels.

According to exemplary embodiments of the present inventive concept, first row sub-pixels disposed on a first row PR1 of the matrix are alternately connected to the first gate line G1 and the second gate line G2 by a unit (e.g., pair) of two sub-pixels. For example, a first pair of two adjacent sub-pixels, from among the plurality of sub-pixels of the first row PR1, such as sub-pixels P1 and P2, may be connected to the first gate line G1. A second pair of two adjacent sub-pixels, from among the plurality of sub-pixels of the first row PR1, such as sub-pixels P3 and P4, may be connected to the second gate line G2. The sub-pixel P3 may be adjacent to the sub-pixel P2. Second row sub-pixels disposed on a second row PR2 of the matrix adjacent to the first row PR1 may be alternately connected to the second gate line G2 and the third gate line G3 by a unit of two sub-pixels. For example, a first pair of two adjacent sub-pixels, from among the plurality of sub-pixels of the second row PR2, such as sub-pixels P9 and P10, may be connected to the second gate line G2. A second pair of two adjacent sub-pixels, from among the plurality of sub-pixels of the second row PR2, such sub-pixels P11 and P12, may be connected to the third gate line G3. The sub-pixel P11 may be adjacent to the sub-pixel P10. According to an exemplary embodiment of the present inventive concept, when the first sub-pixel P1 disposed on the first row PR1 and the first column PC1 of the matrix is connected to the first gate line G1, a ninth sub-pixel P9 disposed on the second row PR2 and the first column PC1 of the matrix is connected to the second gate line G2.

According to an exemplary embodiment of the present inventive concept, the first row PR1 sub-pixels include first through fourth sub-pixels P1, P2, P3 and P4. The first through fourth sub-pixels P1, P2, P3 and P4 may be disposed between the first and second gate lines G1 and G2 and sequentially arranged along the first direction DR1. The first sub-pixel P1 and the second sub-pixel P2 may be connected to the first gate line G1. The third sub-pixel P3 and the fourth sub-pixel P4 may be connected to the second gate line G2.

According to an exemplary embodiment of the present inventive concept, the first row PR1 sub-pixels include fifth through eighth sub-pixels P5, P6, P7 and P8 that may be disposed between the first and second gate lines G1 and G2. The fifth through eighth sub-pixels P5, P6, P7 and P8 may be sequentially arranged along the first direction DR1. The fifth sub-pixel P5 may be adjacent to the fourth sub-pixel P4 along the first direction DR1. The second row sub-pixels may include ninth through twelfth sub-pixels P9, P10, P11 and P12 disposed between the second and third gate lines G2 and G3. The ninth sub-pixel P9 may be adjacent to the first sub-pixel P1 along the second direction DR2. The tenth sub-pixel P10 may be adjacent to the second sub-pixel P2 along the second direction DR2. The eleventh sub-pixel P11 may be adjacent to the third sub-pixel P3 along the second direction DR2. The twelfth sub-pixel P12 may be adjacent to the fourth sub-pixel P4 along the second direction DR2.

According to an exemplary embodiment of the present inventive concept, each of the gate lines may be alternately connected to two sub-pixels at an upper side with respect to each of the gate lines and two sub-pixels at a lower side with respect to each of the gate lines. For example, the second gate line G2 may be sequentially connected to the ninth and tenth sub-pixels P9 and P10 disposed on the second row and the third and fourth sub-pixels P3 and P4 disposed on the first row.

According to an exemplary embodiment of the present inventive concept, the first sub-pixel P1 is disposed between the first and second data lines D1 and D2. The first sub-pixel P1 may be electrically connected to the first gate line G1. The second sub-pixel P2 may be disposed between the second and third data lines D2 and D3. The second sub-pixel P2 may be electrically connected to the first gate line G1. The third sub-pixel P3 may be disposed between the third and fourth data lines D3 and D4. The third sub-pixel P3 may be electrically connected to the second gate line G2. The fourth sub-pixel P4 may be disposed between the fourth and fifth data lines D4 and D5. The fourth sub-pixel P4 may be electrically connected to the second gate line G2.

According to an exemplary embodiment of the present inventive concept, the fifth sub-pixel P5 is disposed between the fifth and sixth data lines D5 and D6. The fifth sub-pixel P5 may be electrically connected to the first gate line G1. The sixth sub-pixel P6 may be disposed between the sixth and seventh data lines D6 and D7. The sixth sub-pixel P6 may be electrically connected to the first gate line G1. The seventh sub-pixel P7 may be disposed between the seventh and eighth data lines D7 and D8. The seventh sub-pixel P7 may be electrically connected to the second gate line G2. The eighth sub-pixel P8 may be disposed between the eighth and ninth data lines D8 and D9. The eighth sub-pixel P8 may be electrically connected to the second gate line G2.

The ninth sub-pixel P9 may be electrically connected to the second gate line G2. The tenth sub-pixel P10 may be electrically connected to the second gate line G2. The eleventh sub-pixel P11 may be electrically connected to the third gate line G3. The twelfth sub-pixel P12 may be electrically connected to the third gate line G3.

According to an exemplary embodiment of the present inventive concept, the first sub-pixel P1, the fifth sub-pixel P5 and the eleventh sub-pixel P11 may display a first color. The second sub-pixel P2, the sixth sub-pixel P6 and the twelfth sub-pixel P12 may display a second color. The third sub-pixel P3, the seventh sub-pixel P7 and the ninth sub-pixel P9 may display a third color. The fourth sub-pixel P4, the eighth sub-pixel P8 and the tenth sub-pixel P10 may display a fourth color.

The first color may be, for example, red. The second color may be, for example, green. The third color may be, for example, blue. The fourth color may be, for example, white. Alternatively, the first through fourth colors may be different from the color red, the color green, the color blue, and the color white.

Polarities of the data voltages applied to the data lines will be described in detail with reference to FIGS. 3A and 3B.

Figure 2B:
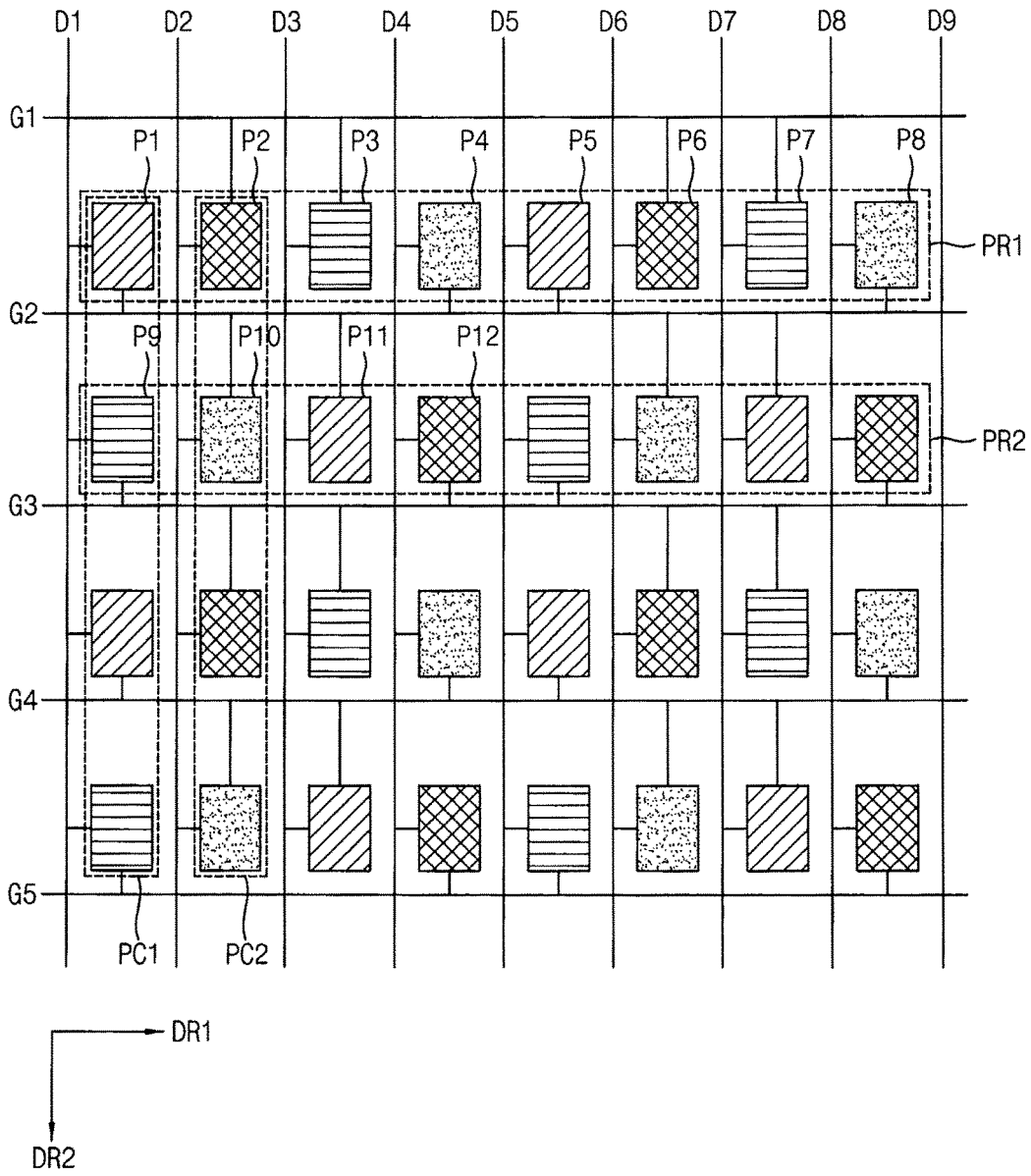
FIG. 2B illustrates a diagram of a pixel arrangement of a display panel of the display apparatus illustrated in FIG. 1, according to exemplary embodiments of the present inventive concept.

FIG. 2B illustrates a diagram of a pixel arrangement of a display panel of the display apparatus illustrated in FIG. 1, according to exemplary embodiments of the present inventive concept.

Referring to FIGS. 1 and 2B, according to an exemplary embodiment of the present inventive concept, the first sub-pixel P1 is disposed between the first and second data lines D1 and D2. The first sub-pixel P1 may be electrically connected to the second gate line G2. The second sub-pixel P2 may be disposed between the second and third data lines D2 and D3. The second sub-pixel P2 may be electrically connected to the first gate line G1. The third sub-pixel P3 may be disposed between the third and fourth data lines D3 and D4. The third sub-pixel P3 may be electrically connected to the first gate line G1. The fourth sub-pixel P4 may be disposed between the fourth and fifth data lines D4 and D5. The fourth sub-pixel P4 may be electrically connected to the second gate line G2.

According to an exemplary embodiment of the present inventive concept, the fifth sub-pixel P5 is disposed between the fifth and sixth data lines D5 and D6. The fifth sub-pixel P5 may be electrically connected to the second gate line G2. The sixth sub-pixel P6 may be disposed between the sixth and seventh data lines D6 and D7. The sixth sub-pixel P6 may be electrically connected to the first gate line G1. The seventh sub-pixel P7 may be disposed between the seventh and eighth data lines D7 and D8. The seventh sub-pixel P7 may be electrically connected to the first gate line G1. The eighth sub-pixel P8 may be disposed between the eighth and ninth data lines D8 and D9. The eighth sub-pixel P8 may be electrically connected to the second gate line G2.

The ninth sub-pixel P9 may be electrically connected to the third gate line G3. The tenth sub-pixel P10 may be electrically connected to the second gate line G2. The eleventh sub-pixel P11 may be electrically connected to the second gate line G2. The twelfth sub-pixel P12 may be electrically connected to the third gate line G3.

Figure 2C:
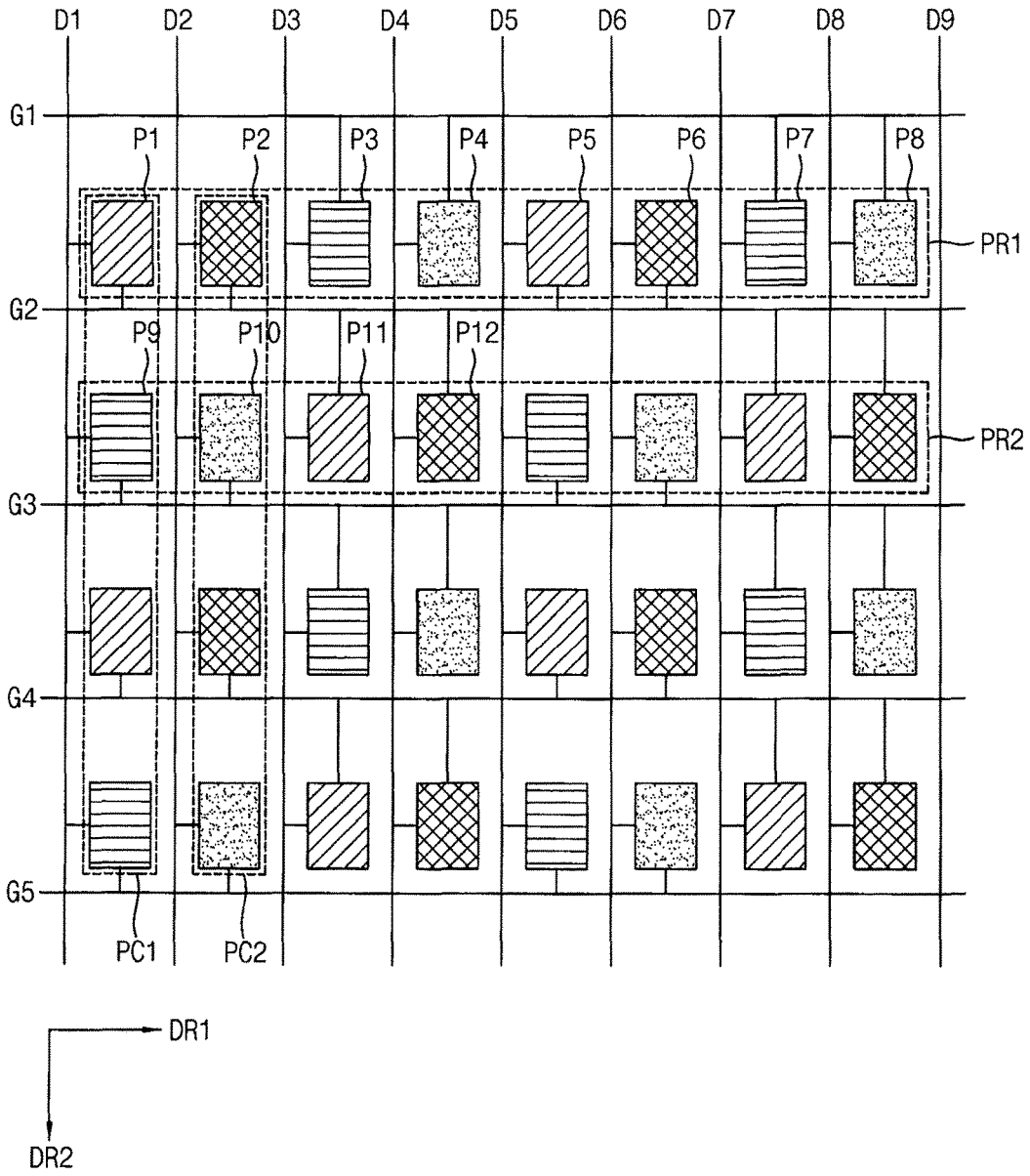
FIG. 2C illustrates a diagram of a pixel arrangement of a display panel of the display apparatus illustrated in FIG. 1, according to exemplary embodiments of the present inventive concept.

FIG. 2C illustrates a diagram of a pixel arrangement of a display panel of the display apparatus illustrated in FIG. 1, according to exemplary embodiments of the present inventive concept.

Referring to FIGS. 1 and 2C, according to an exemplary embodiment of the present inventive concept, the first sub-pixel P1 is disposed between the first and second data lines D1 and D2. The first sub-pixel P1 may be electrically connected to the second gate line G2. The second sub-pixel P2 may be disposed between the second and third data lines D2 and D3. The second sub-pixel P2 may be electrically connected to the second gate line G2. The third sub-pixel P3 may be disposed between the third and fourth data lines D3 and D4. The third sub-pixel P3 may be electrically connected to the first gate line G1. The fourth sub-pixel P4 may be disposed between the fourth and fifth data lines D4 and D5. The fourth sub-pixel P4 may be electrically connected to the first gate line G1.

According to an exemplary embodiment of the present inventive concept, the fifth sub-pixel P5 is disposed between the fifth and sixth data lines D5 and D6. The fifth sub-pixel P5 may be electrically connected to the second gate line G2. The sixth sub-pixel P6 may be disposed between the sixth and seventh data lines D6 and D7. The sixth sub-pixel P6 may be electrically connected to the second gate line G2. The seventh sub-pixel P7 may be disposed between the seventh and eighth data lines D7 and D8. The seventh sub-pixel P7 may be electrically connected to the first gate line G1. The eighth sub-pixel P8 may be disposed between the eighth and ninth data lines D8 and D9. The eighth sub-pixel P8 may be electrically connected to the first gate line G1.

The ninth sub-pixel P9 may be electrically connected to the third gate line G3. The tenth sub-pixel P10 may be electrically connected to the third gate line G3. The eleventh sub-pixel P11 may be electrically connected to the second gate line G2. The twelfth sub-pixel P12 may be electrically connected to the second gate line G2.

Figure 2D:
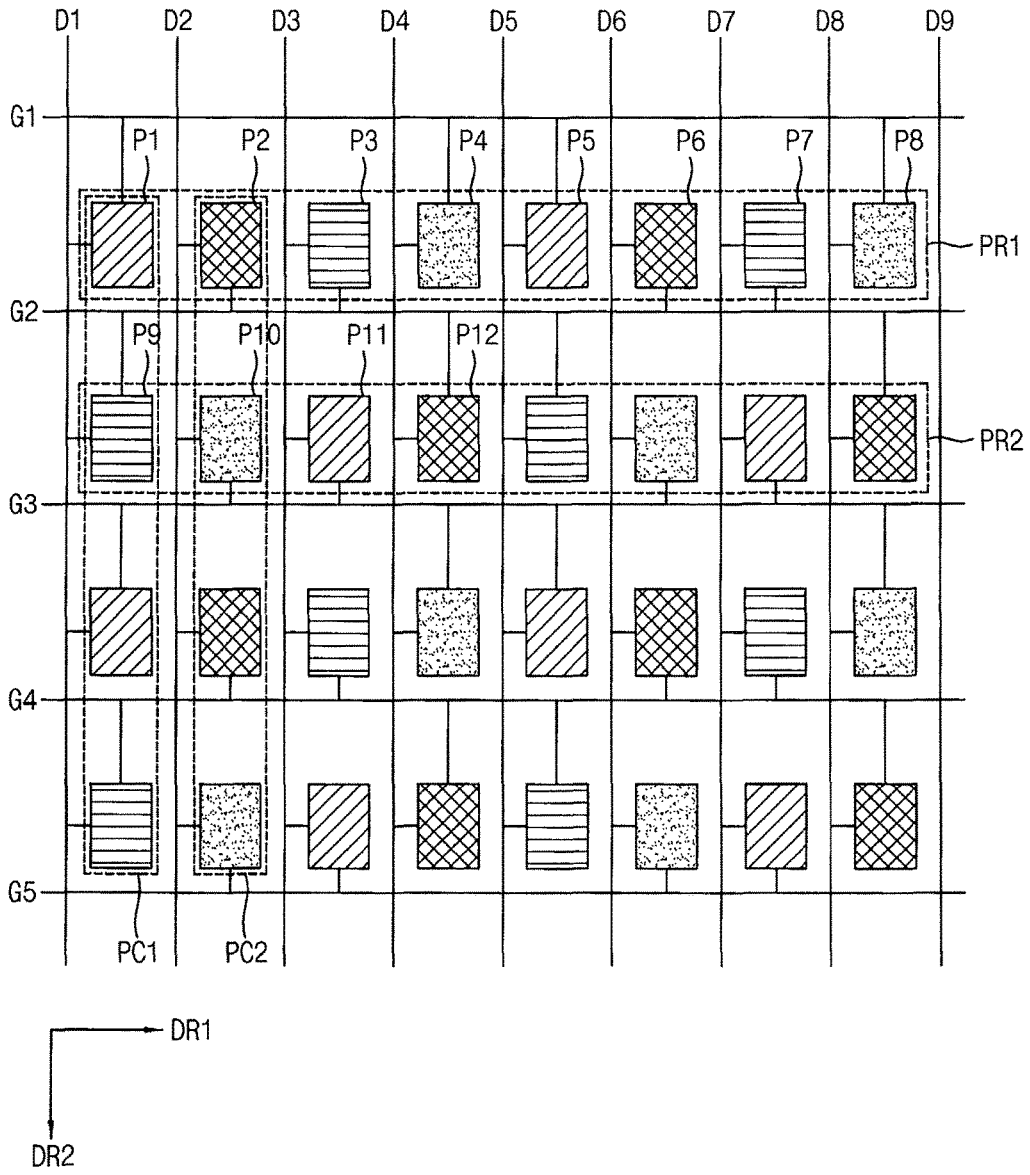
FIG. 2D illustrates a diagram of a pixel arrangement of a display panel of the display apparatus illustrated in FIG. 1, according to exemplary embodiments of the present inventive concept.

FIG. 2D illustrates a diagram of a pixel arrangement of a display panel of the display apparatus illustrated in FIG. 1, according to exemplary embodiments of the present inventive concept.

Referring to FIGS. 1 and 2D, according to an exemplary embodiment of the present inventive concept, the first sub-pixel P1 is disposed between the first and second data lines D1 and D2. The first sub-pixel P1 may be electrically connected to the first gate line G1. The second sub-pixel P2 may be disposed between the second and third data lines D2 and D3. The second sub-pixel P2 may be electrically connected to the second gate line G2. The third sub-pixel P3 may be disposed between the third and fourth data lines D3 and D4. The third sub-pixel P3 may be electrically connected to the second gate line G2. The fourth sub-pixel P4 may be disposed between the fourth and fifth data lines D4 and D5. The fourth sub-pixel P4 may be electrically connected to the first gate line G1.

According to an exemplary embodiment of the present inventive concept, the fifth sub-pixel P5 is disposed between the fifth and sixth data lines D5 and D6. The fifth sub-pixel P5 may be electrically connected to the first gate line G1. The sixth sub-pixel P6 may be disposed between the sixth and seventh data lines D6 and D7. The sixth sub-pixel P6 may be electrically connected to the second gate line G2. The seventh sub-pixel P7 may be disposed between the seventh and eighth data lines D7 and D8. The seventh sub-pixel P7 may be electrically connected to the second gate line G2. The eighth sub-pixel P8 may be disposed between the eighth and ninth data lines D8 and D9. The eighth sub-pixel P8 may be electrically connected to the first gate line G1.

The ninth sub-pixel P9 may be electrically connected to the second gate line G2. The tenth sub-pixel P10 may be electrically connected to the third gate line G3. The eleventh sub-pixel P11 may be electrically connected to the third gate line G3. The twelfth sub-pixel P12 may be electrically connected to the second gate line G2.

According to exemplary embodiment of the present inventive concept, the sub-pixels are arranged in a row (e.g., between two adjacent gate lines) are alternately connected to the upper gate line and to the lower gate line in duos (e.g., a pair of two sub-pixels). For example, referring to FIG. 2A, a first duo, including sub-pixel P1 and sub-pixel P2, may connect to the upper gate line (e.g., the first gate line G1). A second duo, including sub-pixel P3 and sub-pixel P4, may connect to the lower gate line (e.g., the second gate line G2).

According to exemplary embodiments of the present inventive concept, sub-pixels disposed between two adjacent gate lines are alternately connected to the upper and lower gate lines in units of two sub-pixels. In sub-pixels displaying the first color, if the first sub-pixel P1 is connected to the first gate line G1 which is the upper gate line of the first sub-pixel P1, the eleventh sub-pixel P11 is connected to the third gate line G3 which is the lower gate line of the eleventh sub-pixel P11. According to an exemplary embodiment of the present inventive concept, when the first sub-pixel P1 is connected to the second gate line G2 which is the lower gate line of the first sub-pixel P1, the eleventh sub-pixel P11 is connected to the second gate line G2 which is the upper gate line of the eleventh sub-pixel P11. Accordingly, a pair of sub-pixels displaying the same color, from among sub-pixels located in two consecutive (e.g., adjacent) rows, are alternately connected to gate lines located in different directions (e.g., upper and lower gates) with respect to each of the sub-pixels. Thus, a difference in brightness between two sub-pixels displaying the same color and arranged in adjacent rows may be reduced when the sub-pixels alternately connect to the upper gate line and the lower gate line, respectively, with respect to the gate lines surrounding the sub-pixels.

Figure 3A:
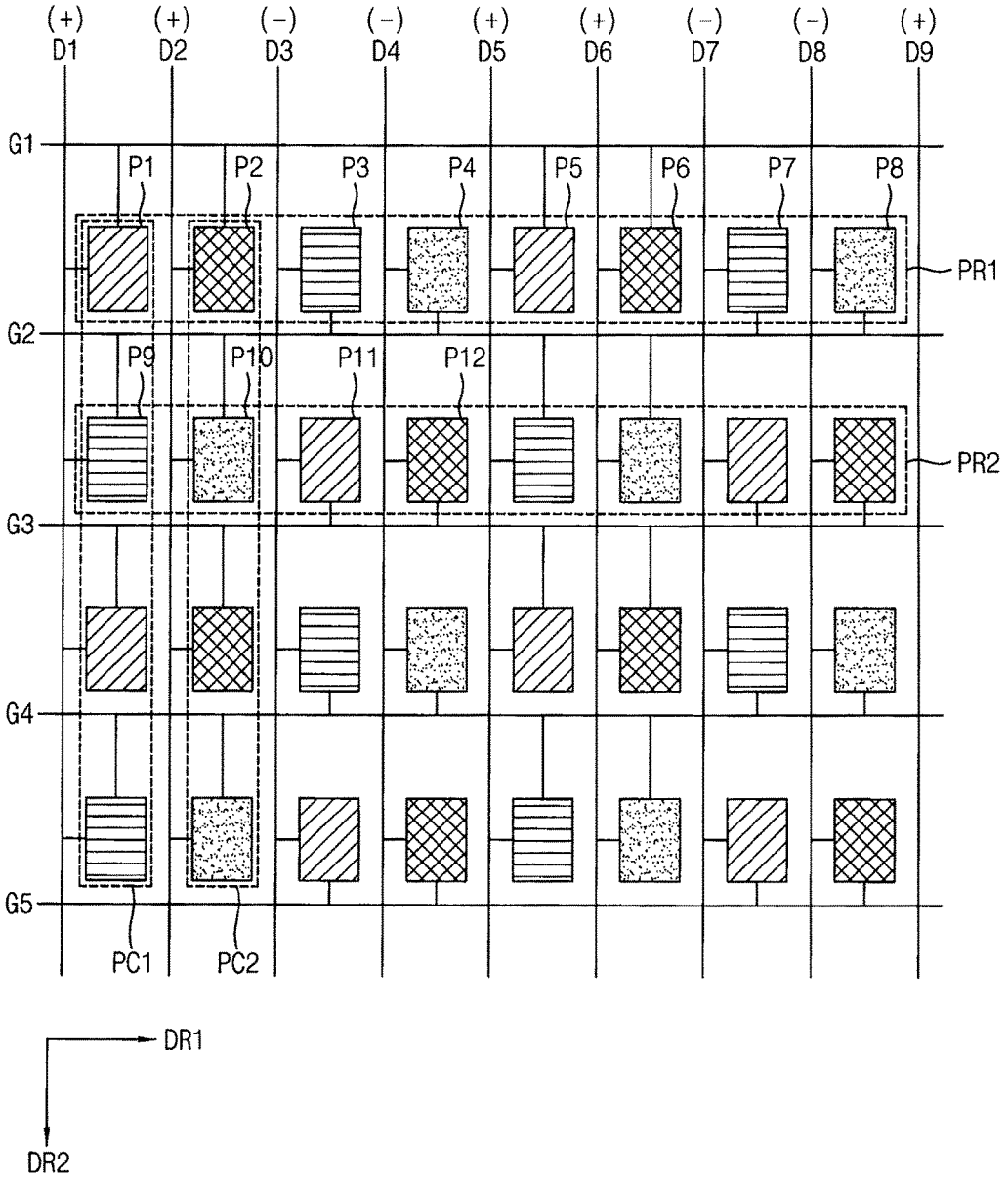
FIG. 3A illustrates a diagram indicating a polarity of each data line of the display panel illustrated in FIG. 2A, according to exemplary embodiments of the present inventive concept.

FIG. 3A illustrates a diagram indicating a polarity of each data line of the display panel illustrated in FIG. 2A according to exemplary embodiments of the present inventive concept.

Referring to FIGS. 1 and 3A, according to an exemplary embodiment of the present inventive concept, data voltages having a first polarity are output to the first data line D1. Data voltages having the first polarity may be output to the second data line D2. Data voltages having a second polarity different from the first polarity may be output to the third data line D3. Data voltages having the second polarity may be output to the fourth data line D4.

Data voltages having the first polarity may be output to the fifth data line D5. Data voltages having the first polarity may be output to the sixth data line D6. Data voltages having the second polarity may be output to the seventh data line D7. Data voltages having the second polarity may be output to the eighth data line D8.

According to an exemplary embodiment of the present inventive concept, the first polarity may be a positive polarity with respect to a common voltage. The second polarity may be a negative polarity with respect to the common voltage. Alternatively, the first polarity may be the negative polarity. The second polarity may be the positive polarity.

The polarities of the data voltages may be inversed by each frame.

Figure 3B:
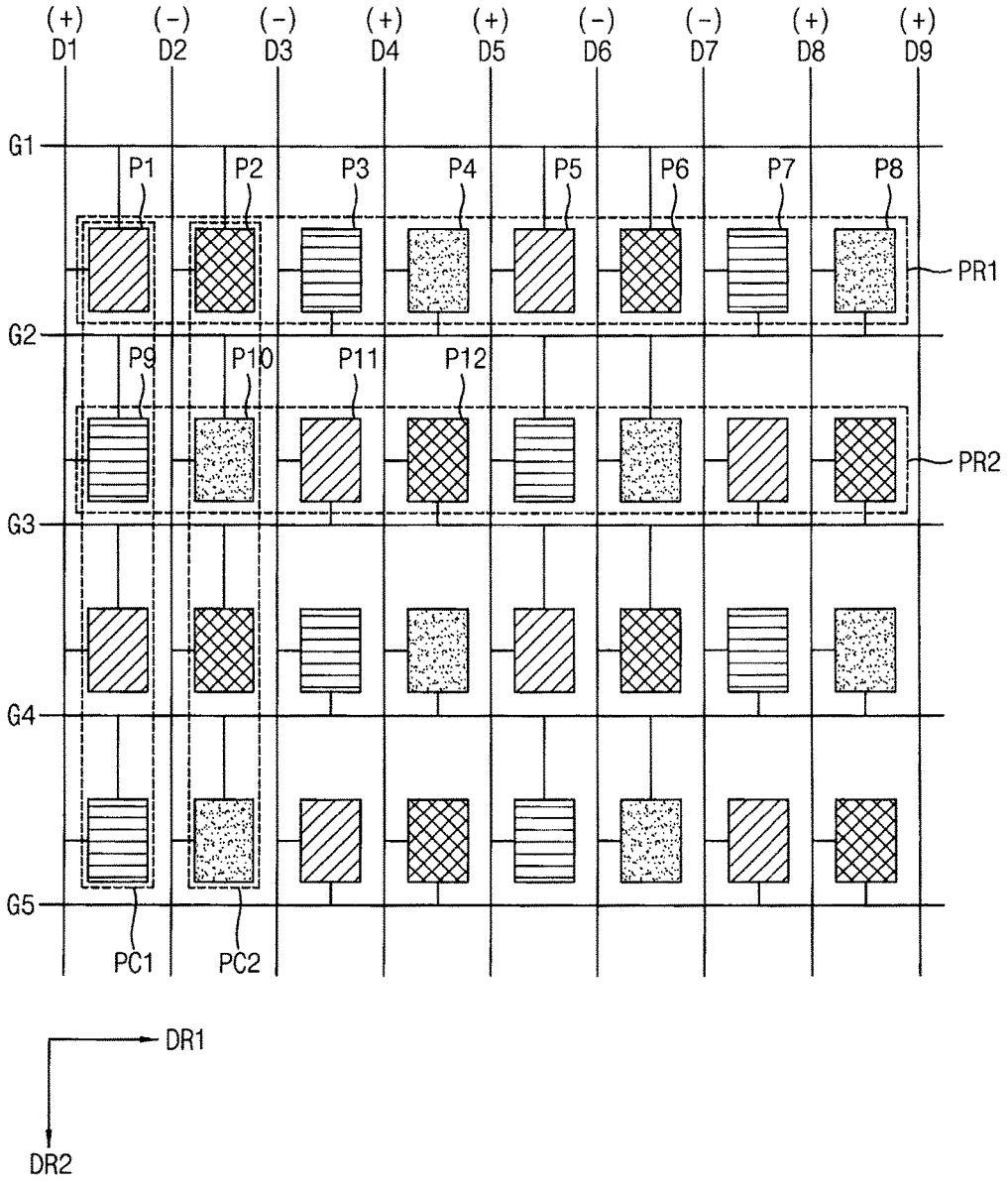
FIG. 3B illustrates a diagram indicating a polarity of each data line of the display panel illustrated in FIG. 2A, according to exemplary embodiments of the present inventive concept.

FIG. 3B illustrates a diagram indicating a polarity of each data line of the display panel illustrated in FIG. 2A, according to exemplary embodiments of the present inventive concept.

Referring to FIGS. 1 and 3B, according to an exemplary embodiment of the present inventive concept, data voltages having a first polarity are output to the first data line D1. Data voltages having a second polarity different from the first polarity may be output to the second data line D2. Data voltages having the second polarity may be output to the third data line D3. Data voltages having the first polarity may be output to the fourth data line D4.

Data voltages having the first polarity may be output to the fifth data line D5. Data voltages having the second polarity may be output to the sixth data line D6. Data voltages having the second polarity may be output to the seventh data line D7. Data voltages having the first polarity may be output to the eighth data line D8.

According to an exemplary embodiment of the present inventive concept, the first polarity may be a positive polarity with respect to a common voltage. The second polarity may be a negative polarity with respect to the common voltage. Alternatively, the first polarity may be the negative polarity. The second polarity may be the positive polarity.

The polarities of the data voltages may be inversed by each frame.

According to the exemplary embodiments of the present inventive concept, data voltages having different polarities from each other are applied to sub-pixels displaying the same color in two line intervals. Thus, flicker and vertical line caused when data voltages having the same polarities are applied to adjacent sub-pixels may be reduced.

The foregoing disclosure is illustrative of the present inventive concept and is not to be construed as limiting the present inventive concept thereto. Those skilled in the art will readily appreciate that many modifications may be made to the disclosed exemplary embodiments without materially departing from the spirit and scope of the present inventive concept. Accordingly, all such modifications are intended to be covered by the scope of the present inventive concept as defined in the claims.

What is claimed is:

1. A display panel comprising:

a plurality of gate lines extending in a first direction and comprising first and second gate lines adjacent to each other;

a plurality of data lines extending in a second direction that crosses the first direction and comprising first and second data lines adjacent to each other; and a plurality of sub-pixels arranged in a matrix configuration, each row of the matrix being disposed between two adjacent gate lines, from among the plurality of gate lines, each column of the matrix being disposed between two adjacent data lines, from among the plurality of data lines, the plurality of sub-pixels comprising:

first row sub-pixels disposed on a first row of the matrix; and second row sub-pixels disposed on a second row of the matrix, wherein the second gate line is alternately connected to the first row sub-pixels and second row sub-pixels in units of two sub-pixels, and wherein each of the two sub-pixels of each unit of two sub-pixels are adjacent to each other.

2. The display panel of claim 1, wherein when a first sub-pixel disposed on the first row of the matrix and a first column of the matrix is connected to the first gate line, a second sub-pixel disposed on the second row of the matrix and the first column of the matrix is connected to the second gate line.

3. The display panel of claim 1, wherein the first row sub-pixels comprise first through fourth sub-pixels disposed between the first and second gate lines and sequentially arranged along the first direction, and the first and second sub-pixels are connected to the first gate line, and the third and fourth sub-pixels are connected to the second gate line.

4. The display panel of claim 3, wherein the first sub-pixel displays a first color, the second sub-pixel displays a second color, the third sub-pixel displays a third color, and the fourth sub-pixel displays a fourth color.

5. The display panel of claim 4, wherein the first color is red, the second color is green, the third color is blue, and the fourth color is white.

6. The display panel of claim 3, wherein the plurality of data lines further comprises third and fourth data lines adjacent to each other, the third data line being adjacent to the second data line, the first and second data lines are configured to apply data voltages having a first polarity to the first and second sub-pixels, respectively, and the third and fourth data lines are configured to apply data voltages having a second polarity to the third and fourth sub-pixels, respectively, the second polarity being different from the first polarity.

7. The display panel of claim 3, wherein the plurality of data lines further comprises third and fourth data lines adjacent to each other, the third data line being adjacent to the second data line, the first and fourth data lines are configured to apply data voltages having a first polarity to the first and fourth sub-pixels, respectively, and the second and third data lines are configured to apply data voltages having a second polarity to the second and third sub-pixels, respectively, the second polarity being different from the first polarity.

8. The display panel of claim 3, wherein the second row sub-pixels comprise fifth through eighth sub-pixels disposed between the second and third gate lines and sequentially arranged along the first direction, the fifth sub-pixel being adjacent to the first sub-pixel and the sixth sub-pixel being adjacent to the second sub-pixel, the fifth and sixth sub-pixels being connected to the second gate line, and the seventh sub-pixel being adjacent to the third sub-pixel and the eighth sub-pixel being adjacent to the fourth sub-pixel, the seventh and eighth sub-pixels being connected to the third gate line.

9. The display panel of claim 3, wherein the first row sub-pixels further comprise fifth through eighth sub-pixels disposed between the first and second gate lines and sequentially arranged along the first direction, and the fifth sub-pixel is adjacent to the fourth sub-pixel, the fifth and sixth sub-pixels are connected to the first gate line, and the seventh and eighth sub-pixels are connected to the second gate line.

10. The display panel of claim 3, wherein the first sub-pixel is disposed between the first and second data lines and is connected to the first data line.

11. The display panel of claim 3, wherein the plurality of data lines further comprises a third data line adjacent to the second data line, and the first sub-pixel is disposed between the second and third data lines and is connected to the second data line.

12. The display panel of claim 3, wherein a first pixel comprises the first and second sub-pixels, and a second pixel comprises the third and fourth sub-pixels.

13. A display apparatus comprising:

a display panel comprising:

a plurality of gate lines extending in a first direction and comprising first and second gate lines adjacent to each other;

a plurality of data lines extending in a second direction that crosses the first direction and comprising first and second data lines adjacent to each other; and a plurality of sub-pixels arranged in a matrix configuration, each row of the matrix being disposed between adjacent gate lines, from among the plurality of gate lines, each column of the matrix being disposed between adjacent data lines, from among the plurality of data lines, the plurality of sub-pixels comprising:

first column sub-pixels disposed on a first column of the matrix and connected to the first data line;

second column sub-pixels disposed on a second column of the matrix and connected to the second data line, the second column being adjacent to the first column;

first row sub-pixels disposed on a first row of the matrix and alternately connected to the first and second gate lines in units of two sub-pixels; and second row sub-pixels disposed on a second row of the matrix and alternately connected to the second and third gate lines in units of two sub-pixels;

a data driver configured to output data voltages to the plurality of data lines; and a gate driver configured to output gate voltages to the plurality of gate lines, wherein the plurality of gate lines further comprises a third gate line adjacent to the second gate line, and wherein the second gate line is alternately connected to the first row sub-pixels and second row sub-pixels in units of two sub-pixels, and wherein each of the two sub-pixels of each unit of two sub-pixels are adjacent to each other.

14. The display apparatus of claim 13, wherein when a first sub-pixel disposed on the first row and the first column of the matrix is connected to the first gate line, a second sub-pixel disposed on the second row and the first column of the matrix is connected to the second gate line.

15. The display apparatus of claim 13, wherein the first row sub-pixels comprise first through fourth sub-pixels disposed between the first and second gate lines and sequentially arranged along the first direction, and the first and second sub-pixels are connected to the first gate line, and the third and fourth sub-pixels are connected to the second gate line.

16. The display apparatus of claim 15, wherein the first sub-pixel displays a first color, the second sub-pixel displays a second color, the third sub-pixel displays a third color, and the fourth sub-pixel displays a fourth color.

17. The display apparatus of claim 15, wherein the plurality of data lines further comprises third and fourth data lines adjacent to each other, the third data line being adjacent to the second data line, the first and second data lines are configured to apply data voltages having a first polarity to the first and second sub-pixels, respectively, and the third and fourth data lines are configured to apply data voltages having a second polarity to the third and fourth sub-pixels, respectively, the second polarity being different from the first polarity.

18. The display apparatus of claim 15, wherein the plurality of data lines further comprises third and fourth data lines adjacent to each other, the third data line being adjacent to the second data line, the first and fourth data lines are configured to apply data voltages having a first polarity to the first and fourth sub-pixels, respectively, and the second and third data lines are configured to apply data voltages having a second polarity to the second and third sub-pixels, respectively, the second polarity being different from the first polarity.

19. The display apparatus of claim 15, wherein the second row sub-pixels comprise fifth through eighth sub-pixels disposed between the second and third gate lines and sequentially arranged along the first direction, the fifth sub-pixel being adjacent to the first sub-pixel and the sixth sub-pixel being adjacent to the second sub-pixel, the fifth and sixth sub-pixels being connected to the second gate line, and the seventh sub-pixel being adjacent to the third sub-pixel and the eighth sub-pixel being adjacent to the fourth sub-pixel, the seventh and eighth sub-pixels being connected to the third gate line.

20. The display apparatus of claim 15, wherein the first row sub-pixels further comprise fifth through eighth sub-pixels disposed between the first and second gate lines and sequentially arranged along the first direction, and the fifth sub-pixel is adjacent to the fourth sub-pixel, the fifth and sixth sub-pixels are connected to the first gate line, and the seventh and eighth sub-pixels are connected to the second gate line.

* * * * *